United States Patent [19]

Bur

[11] 4,383,146

[45] May 10, 1983

[54] FOUR-POLE LOW VOLTAGE CIRCUIT BREAKER

[75] Inventor: Marc Bur, Grenoble, France

[73] Assignee: Merlin Gerin, Grenoble, France

[21] Appl. No.: 240,078

[22] Filed: Mar. 3, 1981

[30] Foreign Application Priority Data

Mar. 12, 1980 [FR] France ..... 80 05589

[51] Int. Cl.[3] ..... H01H 3/00; H01H 9/20; H01H 73/00

[52] U.S. Cl. ..... 200/17 R; 200/50 C; 200/153 G; 335/8; 361/115

[58] Field of Search ..... 200/50 C, 153 G, 153 H, 200/17 R; 335/8, 9, 10; 337/45, 46, 47; 361/115

[56] References Cited

U.S. PATENT DOCUMENTS

| | | | |
|---|---|---|---|
| 3,840,833 | 10/1974 | Muenna et al. | 337/46 X |
| 3,908,104 | 9/1975 | Michetti | 200/50 C |
| 4,242,577 | 12/1980 | Maier et al. | 200/153 G |

FOREIGN PATENT DOCUMENTS

| | | |
|---|---|---|
| 1286188 | 1/1969 | Fed. Rep. of Germany . |
| 1801455 | 7/1970 | Fed. Rep. of Germany . |
| 790947 | 9/1935 | France . |
| 864135 | 4/1941 | France . |
| 1527535 | 4/1968 | France . |

*Primary Examiner*—J. R. Scott
*Attorney, Agent, or Firm*—Parkhurst & Oliff

[57] ABSTRACT

A four-pole circuit breaker has an operating mechanism associated with one of the intermediate main poles, so as to take up an asymmetrical position with respect to the layout of the four poles. The mechanism has springs similar to those of a three-pole breaker. The transverse tie bar is common to the three main poles and is mechanically coupled to a kinetic linkage controlling the fourth pole, so as to bring about the closure of the contacts of the fourth pole before the closure of the contacts of the main poles upon closing of the breaker, in order to match the four-pole load torque to the three-pole motor torque of the mechanism.

5 Claims, 8 Drawing Figures

FOUR-POLE LOW VOLTAGE CIRCUIT BREAKERS

BACKGROUND OF THE INVENTION

1. Field of the Invention

The invention relates to a four-pole low voltage circuit breaker having a common operating mechanism. Four-pole circuit breakers are advantageously obtained by adding to a conventional three-pole circuit breaker another pole unit, the four poles being housed in the same case or the added pole unit being fixedly secured to the three pole housing.

2. Description of the Prior Art

Conventionally an altenating three phase electrical supply system has three power line conductors and the supply of alternating current power is interrupted by means of a three pole circuit breaker having its poles interposed in the line conductors. The power supply system may comprise a fourth neutral conductor connected to the neutral of the power source, for instance for connecting loads between a phase conductor and the neutral conductor. To avoid any risk, the circuit breaker may comprise a fourth pole interposed in the neutral conductor so that all connections between load and power source are interrupted in the opened position of the circuit breaker.

In three-pole circuit breakers a single operating mechanism for controlling all these poles is mounted in the middle pole, and it is clear that by adding the fourth pole unit this mechanism occupies an asymmetrical position. This asymmetrical position causes a flexion of the tie bar and/or of the mechanical connecting link of the pole units and this flexion provides different contact pressures.

SUMMARY OF THE INVENTION

The object of the present invention is to eliminate this drawback and to provide a four-pole circuit breaker having an asymmetrical operating mechanism which provides a uniform contact pressure in the pole units.

Another object of the invention is to provide a four-pole circuit breaker using the same operating mechanism as a three-pole circuit breaker. FIG. 6 shows the graphs of motor torque $CM_3$ and load torque $CR_3$ for a conventional three-pole circuit breaker and FIG. 7 shows the graphs of the corresponding four-pole circuit breaker. It will be noted that the motor torque $CM_3$ must be increased to torque $CM_4$ (dotted line of FIG. 7) for instance by changing the closure springs of the mechanism. According to the present invention the operating linkage of the fourth pole is arranged to bring about the closure of the contacts of the fourth pole before those of the other three poles in such a manner that an operating mechanism providing motor torque $CM_3$ may be used for operating the four-pole circuit breaker, i.e. such that motor torque produced by the operating mechanism may be used, for instance, to close the circuit breaker.

A further object of this invention is to provide a four-pole circuit breaker wherein the movable contacts of the three main poles are rigidly secured to a tie bar extending across all of the three main poles, the tie bar being relieved of the flexion caused by the asymmetry of the operating mechanism.

Further advantages and features of the present invention will become clearer in the course of the following description in conjunction with the attached drawings.

DESCRIPTION OF A PREFERRED EMBODIMENT

Figure 1:
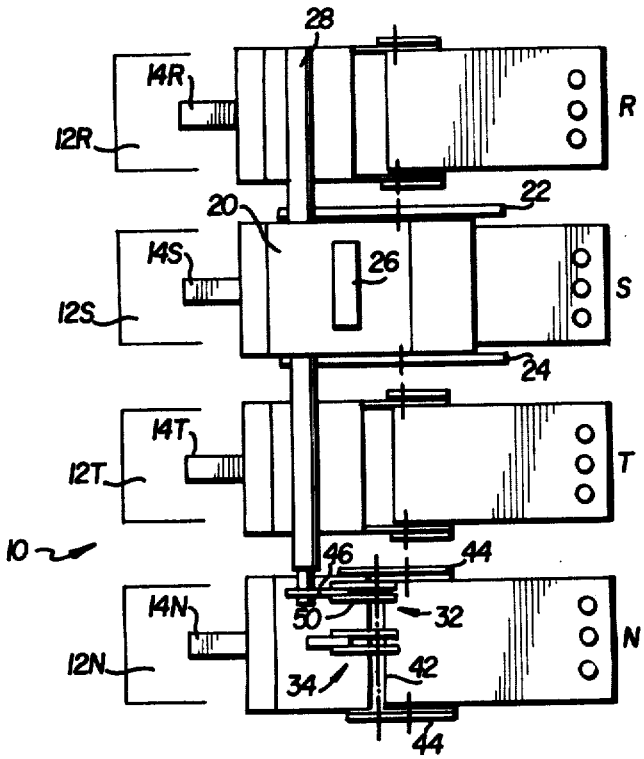
FIG. 1 is a schematic plan view of the breaker fitted with the operating mechanism according to the invention.
Figure 6:
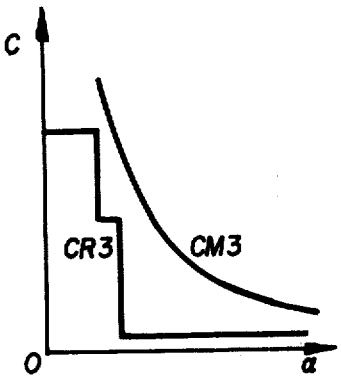
FIG. 6 (PRIOR ART)
FIGS. 6 and 7 display curves of motor and load torque against angular travel of the drive rod of both three and four-pole breakers as previously constructed.
Figure 7:
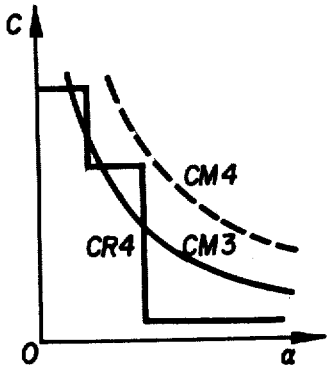
FIG. 7 (PRIOR ART)

In FIGS. 1–5, a four-pole low voltage breaker 10, for use on a three-phase plus neutral network, has three main poles R, S, T, associated with the phase conductors of the network, and a fourth pole N associated with the neutral conductor. The four poles R, S, T and N are mounted in compartments placed side by side within a rectangular moulded insulating case (not shown), the fourth pole N being placed beside the pole T. Each pole R, S, T, N comprises a pair of separable stationary 12 R, 12 S, 12 T, 12 N, and movable 14 R, 14 S, 14 T, 14 N contacts, electrically connected to the upstream and downstream terminals 16 and 18. An operating mechanism 20 is mounted between two parallel cheeks 22, 24 of the intermediate pole S and ensures the displacement of the movable contacts 14 between the open and closed positions, either manually by means of the control lever 26 or automatically by a magnetothermal or electronic trip unit in the case of an overload or short circuit. To reclose contacts 12 and 14, the lever 26 is first swung to the "reset position" and thereafter from the "reset" position to the "breaker closed" position. The operating mechanism 20 is identical with that of a three-pole breaker, and is placed asymmetrically with respect to the four poles R, S, T and N. The operation of the movable contacts between the open and closed positions is brought about through the medium of a tie bar or drive rod 28 extending across the inside of the box. The drive rod 28, as part of the operating mechanism 20, is common to the three main poles R, S, T and has one end mechanically coupled to the support member or carrier of the movable contact 30 N of the fourth pole N by means of the kinetic linkage designated by the general reference 32 and shown in detail in FIGS. 2 to 5.

The kinetic linkage 32 between drive rod 28 and the neutral fourth pole N includes a toggle unit 34 having a knee pivot pin 36 on which are hinged on a lower toggle link 38, pivotally connected to the movable carier 30 N of the fourth pole N by means of a pin 54, and an upper toggle link 40, secured to pivotally mounted transmission axis 42. The axis 42 extends crosswise between the two parallel cheeks 44 arranged on each side of pole N. The drive power is transmitted from the drive rod 28 to the toggle unit 34 by means of a connecting rod 46, one end of which is pivotally connected to the drive rod 28, the other being hinged at point 48 to the lever 50, itself coupled to the transmission axis 42. An elastic means, in the form of a coil spring 52, biases the carrier 30 N of the fourth pole to overcome break-away friction and to shift the toggle unit 34 through the dead-centre position when the breaker is being closed. The spring 52 is threaded on an arm 56, one end of which is pivotally mounted on pin 54. The other end of arm 56 has a guide slot 58 which slides about pin 60, solidly fixed between cheeks 44. Each movable contact 14 R, 14 S, 14 T, 14 N, of the four poles R, S, T, N is mounted on a contact arm 62 by means of a contact spring ensuring adjustable contact pressure. The four contact arm assemblies are located in carriers 30 R, 30 S, 30 T, 30 N respectively. The main pole carriers 30 R, 30 S and 30 T are attached directly to the drive rod 28, while the fourth pole carrier 30 N is coupled to the lower toggle link 38 of the kinetic linkage 32.

Figure 2:
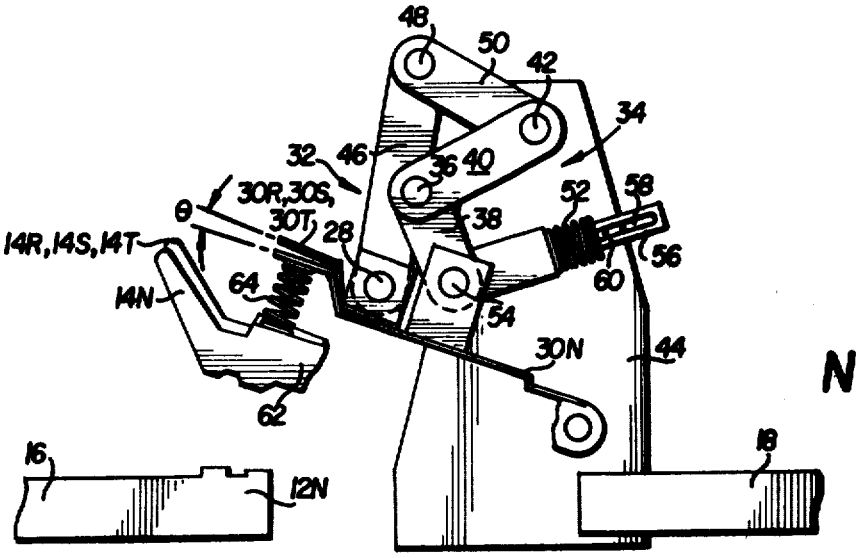
FIGS. 2–5 show schematic views in elevation of the breaker of FIG. 1 for various functional phases of the operating mechanism, that is: fully open, at the end of the closing stroke, fully closed, and at the start of the opening stroke.
Figure 3:
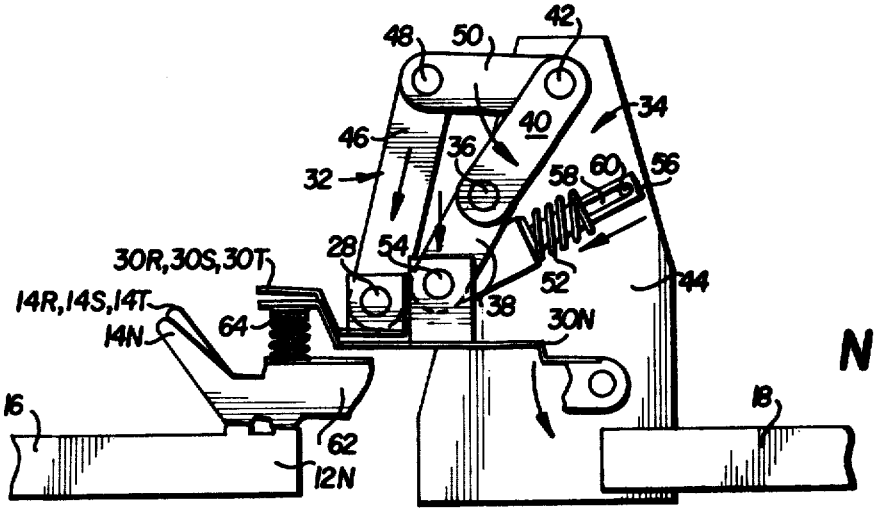
Figure 4:
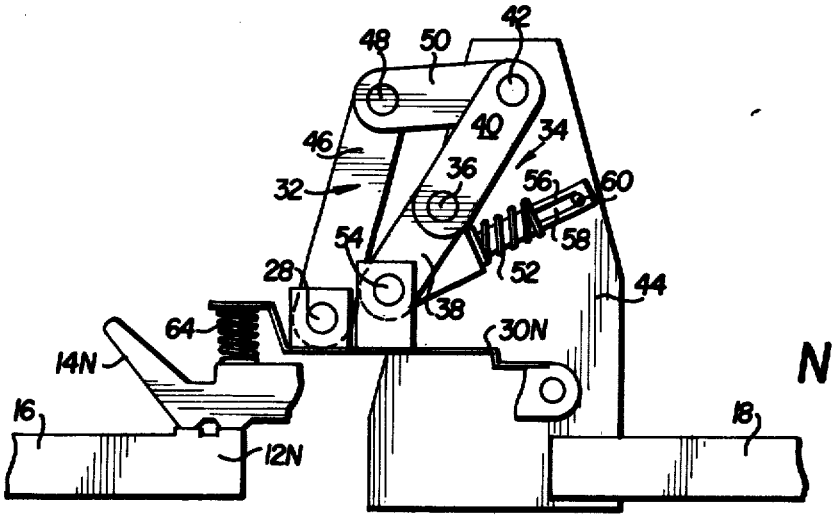
Figure 5:
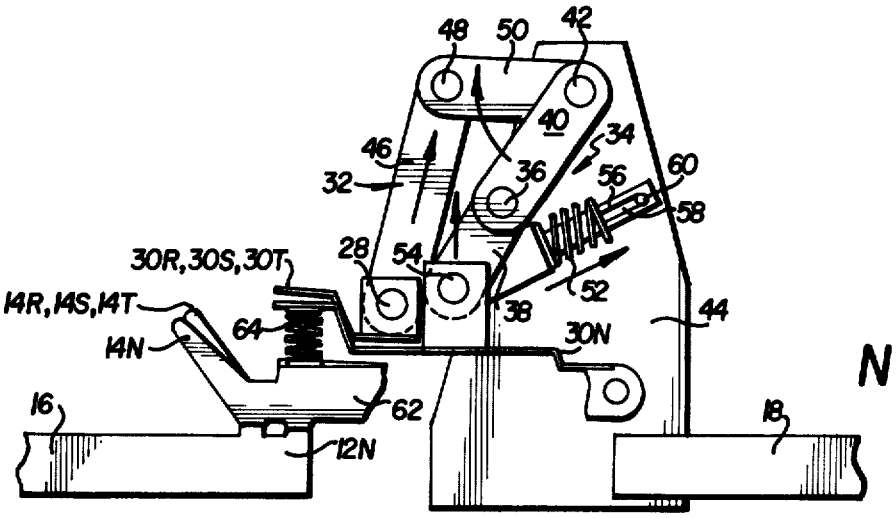

The operating mechanism according to the invention functions as follows:

In the open position of the breaker shown in FIG. 2, the carrier 30 N of pole N is offset from the carriers, 30 R, 30 S and 30 T of the main poles R, S and T by a predetermined angle $\theta$, allowing advanced closure of the contacts 12 N, 14 N of the neutral fourth pole N during the closing stroke. The toggle unit 34 is in a collapsed position, and the arm 56 maintains spring 52 compressed against pin 60.

Figure 8:
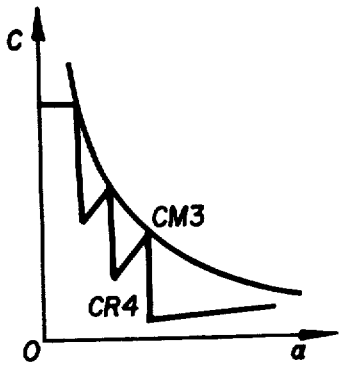
FIG. 8 shows a similar curve for a four-pole breaker according to the invention.

During the closing stroke of the breaker (FIG. 3) by manuually activating lever 26 of the operating mechanism 20 associated with the intermediate main pole S, the drive power transmitted by drive rod 28 to the kinetic linkage 32 brings about closure of the neutral fourth pole N before that of the three main poles R, S and T. The pull of the connecting rod 46 due to the movement of the drive rod 28 causes counter-clockwise rotation of the upper toggle link 40 and the lever 50, itself rigidly fastened to axis 42. The lower toggle link 38 is drawn downwards until the movable contact 14 N is closed. The extension of the spring 52 overcomes friction and eases the toggle unit 34 through the dead-centre position. Advanced closure of the fourth pole N takes place when the lever 26 is near to the closed position, thus matching the four-pole load torque to the three-pole drive torque of the operating mechanism 20 (see FIG. 8). It can be seen that the friction torque has a low value when angle $\alpha$ is large. The coupling of the drive rod 28 of the main poles R, S and T to the kinetic linkage 32 of the N pole enables closure springs as fitted to the operating mechanism of a three-pole breaker to be used for a four-pole breaker.

The arrival of lever 26 at the end of its stroke ensures closure of the main poles R, S, T and enables the toggle unit 34 to pass beyond the dead-centre alignment position of axes 42, 36 and 54 (see FIG. 4) spring 52 takes up a neutral position, and connecting rod 46 is relieved of all force. The carrier 30 N of the fourth pole N exerts no load on the drive rod 28 of operating mechanism 20.

During the opening stroke of the breaker (see FIG. 5) whether manually operated by lever 26 or automatically operated by the trip unit, mechanism 20 operates the drive rod 28, the rotation of which ensures the opening of the three main poles R, S and T before that of the neutral pole N which comes about after collapse of the toggle unit 34 of the kinematic linkage 32. The spring 52 is compressed by the movement of the carrier 30 N during the opening stroke, and the mechanism is returned to the position shown in FIG. 2.

The invention has been described with reference to a four-pole breaker, the case of which houses the operating mechanism 20, the kinetic linkage 32 and the four poles R, S, T and N. The mechanism 20 and the linkage 32 do not require great accuracy and it is obvious that the invention is equally applicable to a four-pole breaker obtained by adding a separate pole N to a three-pole breaker. The pole N to be placed alongside is fitted with the kinetic linkage 32 which need only be coupled to the drive rod 28 of the mechanism 20 of the three-pole breaker.

We claim:

1. A four-pole low-voltage circuit breaker comprising:

three main poles, consisting of one center pole and two adjacent outer poles, and a fourth adjacent neutral pole, each pole having a stationary contact and a contact arm structure carrying a movable contact thereon and being movable between open and closed positions, an operating mechanism associated with said center main pole so as to occupy an asymmetrical position with respect to the layout of the four poles, and including a transverse tie bar extending across all the three main poles and supporting the movable contact arm structures of the three main poles, and a kinetic linkage means connected between the movable contact arm structure of said fourth pole and said tie bar so as to bring about the closure of the contacts of the fourth pole before that of the contacts of the three main poles during the closing of the breaker, and to adapt the four-pole load torque to the three-pole motor torque of the operating mechanism.

2. Four-pole breaker, according to claim 1, wherein said kinetic linkage means includes a toggle structure comprising a first link pivotally connected to said contact arm structure of the fourth pole and a second link rigidly secured to a pivotally mounted axis, a knee pivot pin pivotally connecting said first and second links, said kinetic linkage means being movable by said tie bar from an open position wherein said toggle is collapsed to a closed position wherein said toggle is erected to move said contact arm structure to close said fourth contacts.

3. Four-pole circuit breaker according to claim 2, wherein said kinetic linkage means comprises a crank rigidly secured to said axis and a crank lever pivotally connected to said crank and to said tie bar so that a movement of said tie bar from the open position of said main poles towards the closed position brings about the rotation of said axis and the movement of the toggle from the collapsed position towards the erected position to close said fourth contacts before the three main contacts.

4. Four-pole circuit breaker according to claim 1, wherein the contact arm structure of said neutral pole is offset from the contact arm structures of said main poles in the open position of said contacts in the direction of said stationary contacts so that said operating mechanism brings about the closure of the contacts of said fourth pole before the closure of the contacts of said main poles.

5. Four-pole circuit breaker according to claim 2, wherein the kinetic linkage means comprises a spring means cooperating with the contact arm structure of said fourth pole to bias the latter structure towards the closed position and to ease the toggle through the dead-center position when the breaker is being closed.

* * * * *